US008640268B2

(12) United States Patent
Shek

(10) Patent No.: US 8,640,268 B2
(45) Date of Patent: Feb. 4, 2014

(54) AUTOMATIC TOILET SEAT

(76) Inventor: Michael Shek, San Mateo, CA (US)

( * ) Notice: Subject to any disclaimer, the term of this patent is extended or adjusted under 35 U.S.C. 154(b) by 162 days.

(21) Appl. No.: 13/206,198

(22) Filed: Aug. 9, 2011

(65) Prior Publication Data

US 2013/0036541 A1 Feb. 14, 2013

(51) Int. Cl.
*A47K 13/10* (2006.01)

(52) U.S. Cl.
USPC ..... 4/246.1

(58) Field of Classification Search
USPC ..... 4/246.1
See application file for complete search history.

(56) References Cited

U.S. PATENT DOCUMENTS

| | | | | |
|---|---|---|---|---|
| 5,878,444 | A * | 3/1999 | Convoy | 4/246.1 |
| 2007/0056084 | A1* | 3/2007 | Watt et al. | 4/246.1 |
| 2011/0145985 | A1* | 6/2011 | Lin | 4/246.1 |

* cited by examiner

*Primary Examiner* — Gregory Huson
*Assistant Examiner* — Janie Christiansen

(57) ABSTRACT

The present invention is to provide an automatic toilet seat, including a base body, a toilet lid, a seat, a controller, a first lid lifter, a second lid lifter, a first sensor, a second sensor and a power supply. The controller comprises a micro processor. When the first sensor detects a human body, the micro processor activates the second sensor and drives the toilet lid pivot to a lifting position. When the first sensor detects the human body again, the seat pivots to the lifting position. When the human body is away from the second sensor, the micro processor would drive the toilet lid and the seat pivot to a closing position and deactivate the second sensor. Thus, the automatic toilet seat of the present invention provides a two-stage mechanism of an auto-lifting toilet lid.

11 Claims, 7 Drawing Sheets

AUTOMATIC TOILET SEAT

BACKGROUND OF THE INVENTION

1. Field of the Invention

The present invention relates to an automatic toilet seat.

2. Description of the Prior Art

The conventional toilet seat includes a base body, a seat and a toilet lid. The seat and the toilet lid close the toilet when they are not used. When users need to use the toilet, they have to lift the toilet lid by hands, and then sit down on the seat. For gentlemen, they have to lift both the toilet lid and the seat to urinate. However, sometimes users' hands would touch fecal matters. If users use hands with fecal matters to put down the seat or the toilet lid on the toilet, the toilet would be stained with fecal matters. Besides, some gentlemen often urinate without lifting the seat. As a result, the seat and the inner side of the toilet lid would be stained with urine. And other users have to clean the surface of the seat and the inner side of the toilet before using. Otherwise, users' body would touch the fecal matters and feel uncomfortable. Moreover, uses have dangers of being exploded to those diseases infected by urine.

The present invention is, therefore, arisen to obviate or at least mitigate the above mentioned disadvantages.

SUMMARY OF THE INVENTION

The main object of the present invention is to provide an automatic toilet seat which has an automatic function of lifting a toilet lid.

To achieve above, the automatic toilet seat of the present invention includes a base body, a toilet lid, a seat, a controller, a first lid lifter, a second lid lifter, a first sensor, a second sensor and a power supply.

The base body can be disposed on a toilet. The seat is located between the toilet and the toilet lid. The controller comprises a micro processor. The first lid lifter is used for driving the toilet lid to pivot with respect to the base body. The second lid lifter is used for driving the seat to pivot with respect to the base body. The first sensor is disposed on the toilet lid. The second sensor is disposed on a closing face of the toilet lid.

When the first sensor detects movements of a human body, the micro processor activates the second sensor and the first lid lifter to drive the toilet lid to pivot to a lifting position.

When the first sensor detects movements of the human body again, the micro processor starts up the second lid lifter so that the seat pivots to the lifting position as well.

When the person is absent from a detecting range of the second sensor, the micro processor activates the first lid lifter and the second lifter and deactivates the second sensor so that the toilet lid and the seat would pivot back to a closing position.

The present invention provides a two-stage method of an auto-lifting toilet lid. Thus, users can choose to sit down on the toilet or to lift the seat alternatively. And after being used, the toilet lid and the seat can move back to the closing position automatically.

DETAILED DESCRIPTION OF THE PREFERRED EMBODIMENTS

Figure 1:
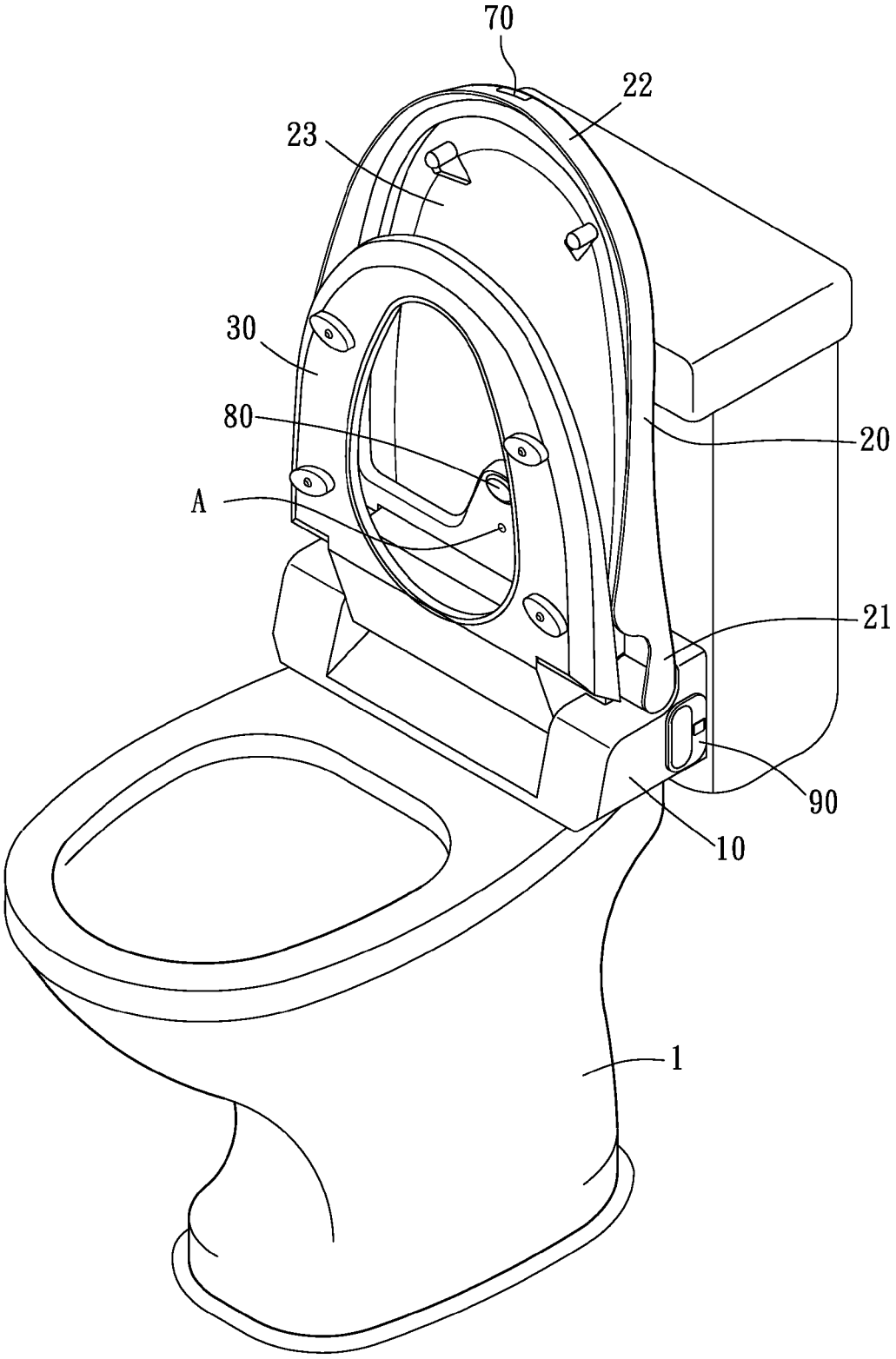
FIG. 1 is a schematic drawing showing a combination of the toilet and the automatic toilet seat in accordance with a preferred embodiment of the present invention.
Figure 2:
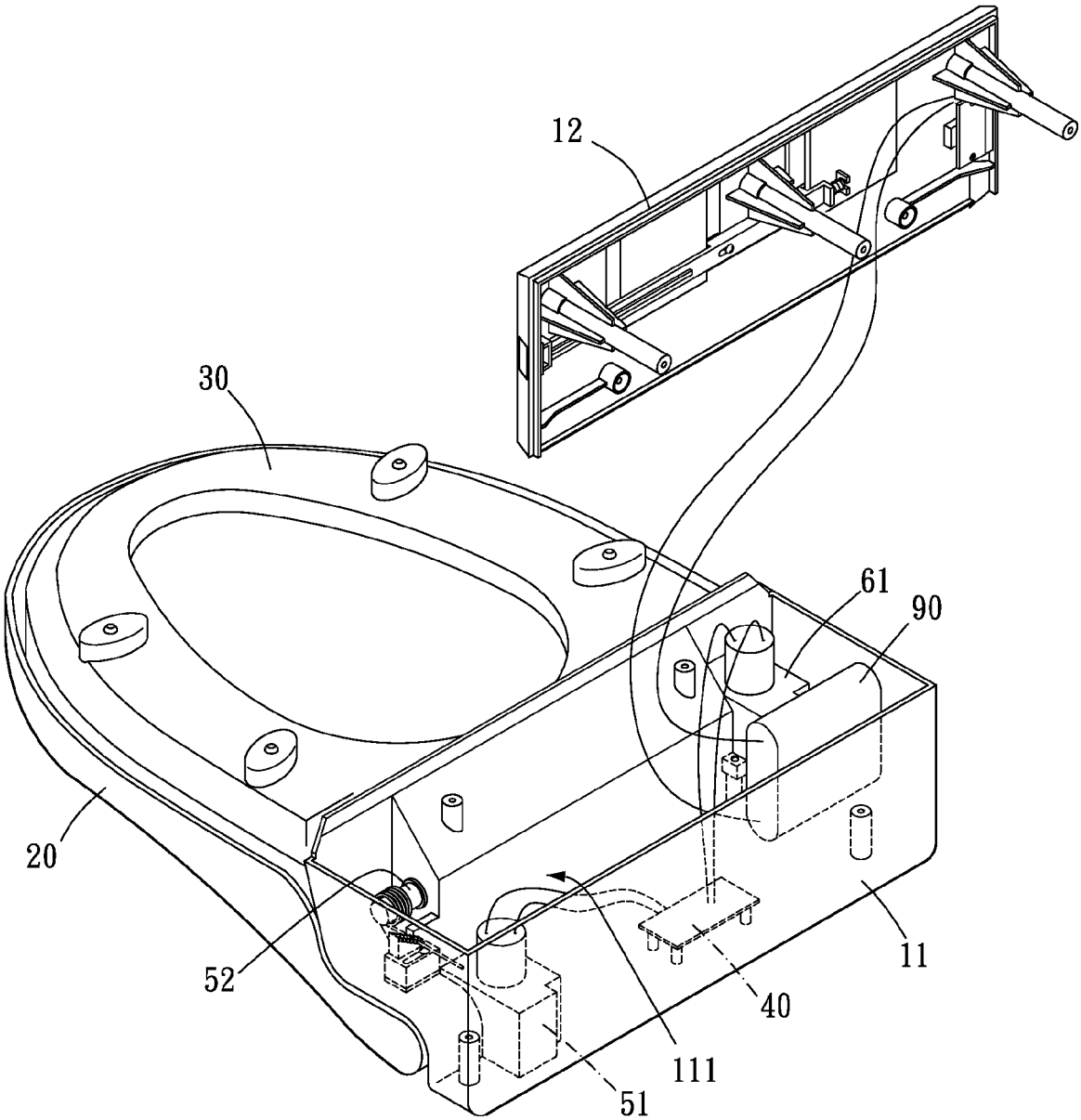
FIG. 2 is a decomposition drawing of the present invention.
Figure 7:
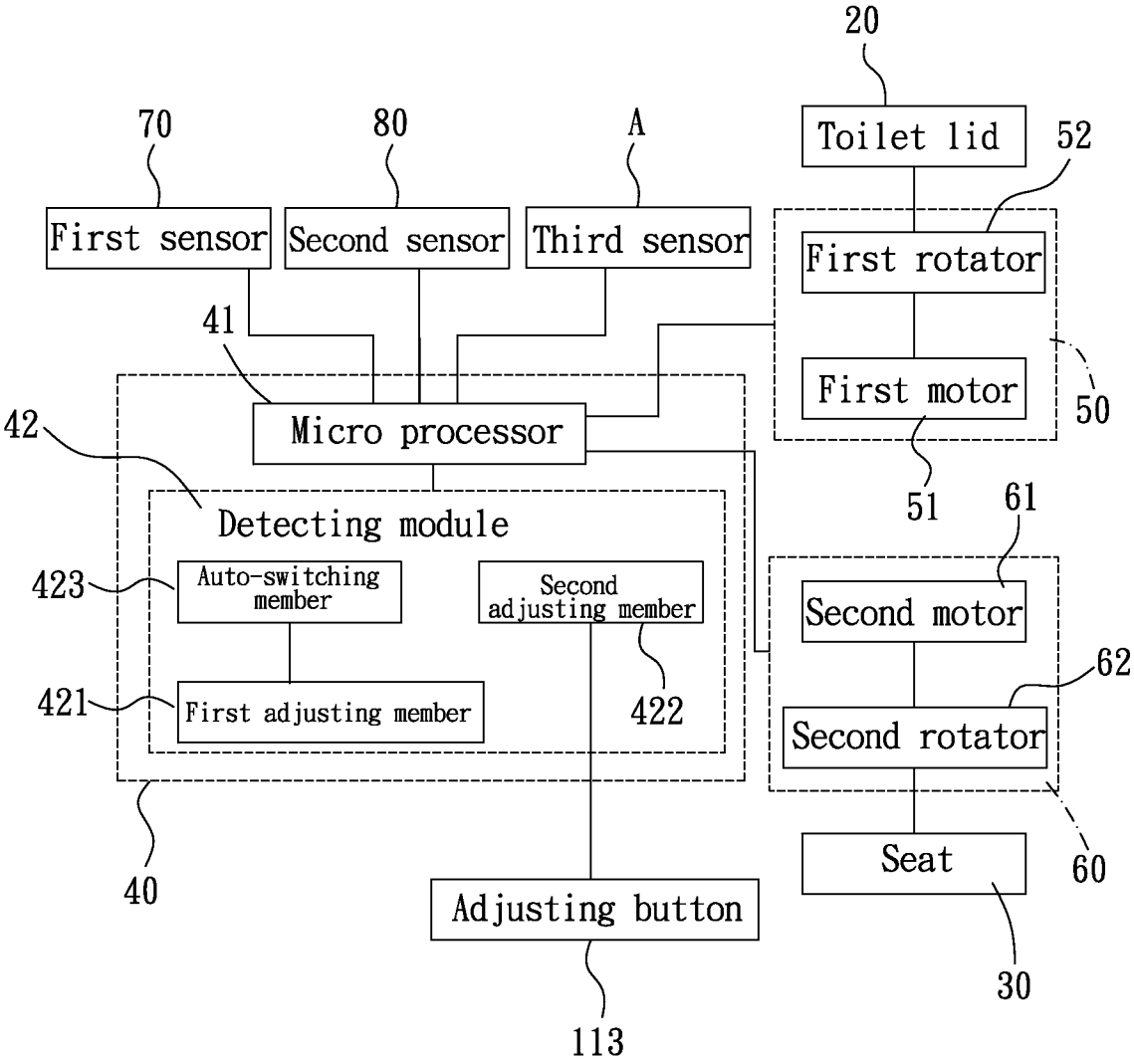
FIG. 7 is a block diagram of the present invention.

Please refer to FIG. 1, FIG. 2 and FIG. 7, the automatic toilet seat of the present invention includes a base body 10, a toilet lid 20, a seat 30, a controller 40, a first lid lifter 50, a second lid lifter 60, a first sensor 70, a second sensor 80, a power supply 90, a first adjusting unit and a second adjusting unit.

Figure 5:
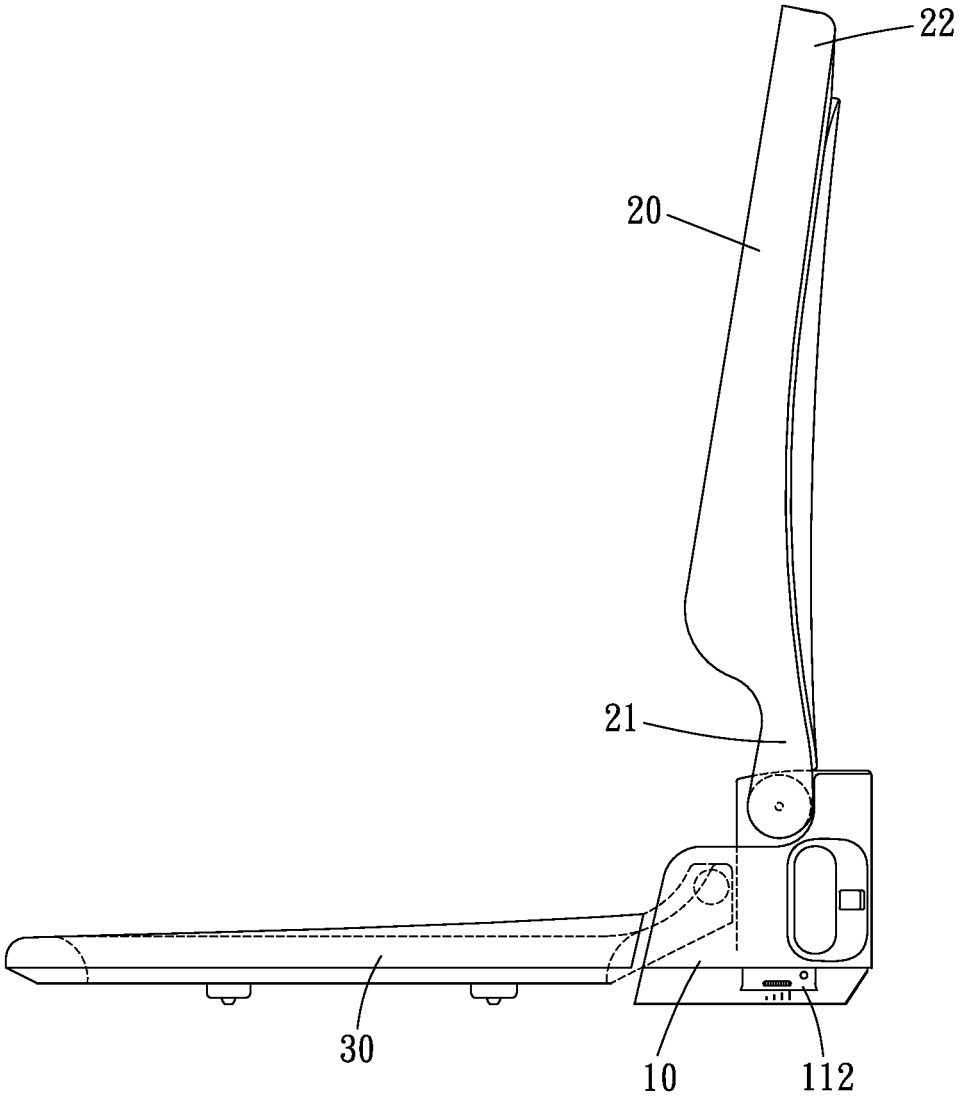
FIG. 5 is a side view showing of the FIG. 4.
Figure 6:
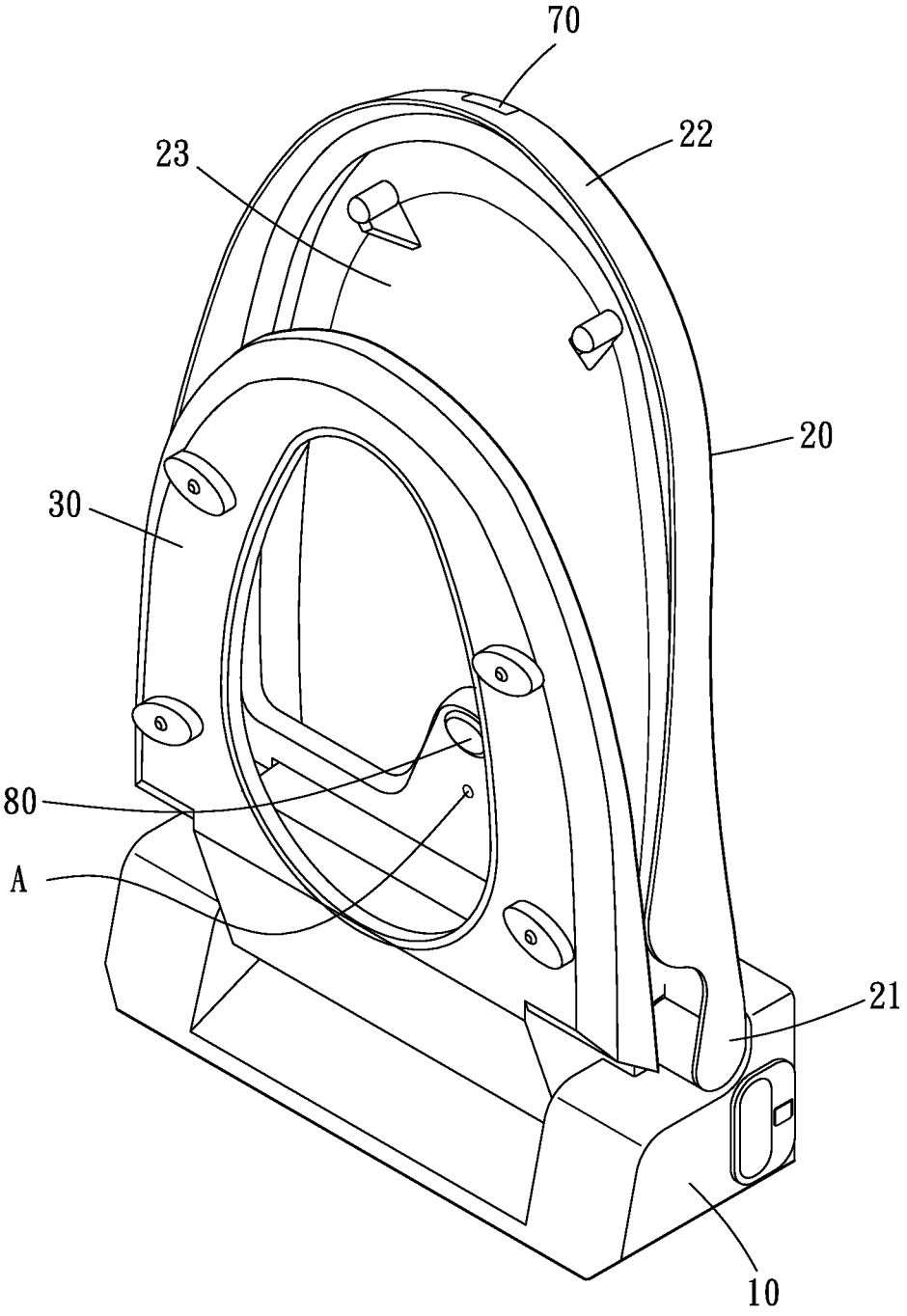
FIG. 6 is a schematic drawing showing a condition that the toilet lid and the seat are lifted of the present invention.

As shown in FIG. 1 and FIG. 2, the base body is disposed on a toilet. The base body 10 includes a shell 11 and a bottom lid 12. The shell 11 is formed with a receiving room 111, and the bottom lid 12 is fixed on the toilet 1. In the preferred embodiment of the present invention, the shell 11 has an operation panel 112 (as shown in FIG. 5). In other possible embodiment, the operation panel 112 can be also fixed on the toilet lid 20 or the seat 30.

The toilet lid 20 has a first end 21 and a second end 22. The first end 21 can be pivotally disposed on the base body 10, and the second end 22 is located at one end of the toilet lid 20 away from the base body 10. That is, the first 21 end can be pivotally disposed on the shell 11 of the base body 10.

The seat 30, located between the toilet 1 and the toilet lid 20, can be pivotally disposed on the base body 10. That is, the seat 30 can be pivotally disposed on the shell 11 of the base body 10.

In the preferred embodiment of the present invention, as shown in FIG. 2 and FIG. 7, the controller 40 is disposed in the receiving room 111 of the shell 11. The controller 40 includes a micro processor 41 and a detecting module 42. The detecting module 42 connects to the micro processor 41 electrically. The detecting module 42 includes a first adjusting member 421 defining plural detecting ranges of the first sensor; and a second adjusting member 422 defining plural detecting ranges of the second sensor.

FIG. 2 and FIG. 7 disclose an embodiment that the first lid lifter 50 is disposed in the base body 10. Preferably, the first lid lifter 50 can be disposed in the receiving room 111. The first lid lifter 50 connects to the micro processor 41 electrically. The first lid lifter 50 is used for driving the toilet lid 20 to pivot with respect to the base body between a lifting position and a closing position. When the toilet lid is located at the closing position, the toilet lid defines a face facing the toilet as a closing face 23. In the present embodiment of the present invention, the first lid lifter 50 includes a first motor 51 connecting to the micro processor 41, and a first rotator 52. The micro processor 41 activates the first motor 51 to drive the first rotator 52 to lift or to close the toilet lid 20.

The second lid lifter 60 is disposed in the base body 10. Preferably, the second lid lifter 60 is disposed in the receiving room 111. The second lid lifter 60 connects to the micro processor 41 electrically. The second lid lifter is used for driving the seat 30 to pivot with respect to the base body 10 between a lifting position and a closing position. In the preferred embodiment of the present invention, the second lid lifter 60 includes a second motor 61 and a second rotator 62. The second motor 61 electrically connects to the micro processor 41. The micro processor 62 triggers the second motor 61 to drives the second rotator 62. Thus, the second rotator 62 can rotate to lift or to close the seat 30.

Figure 3:
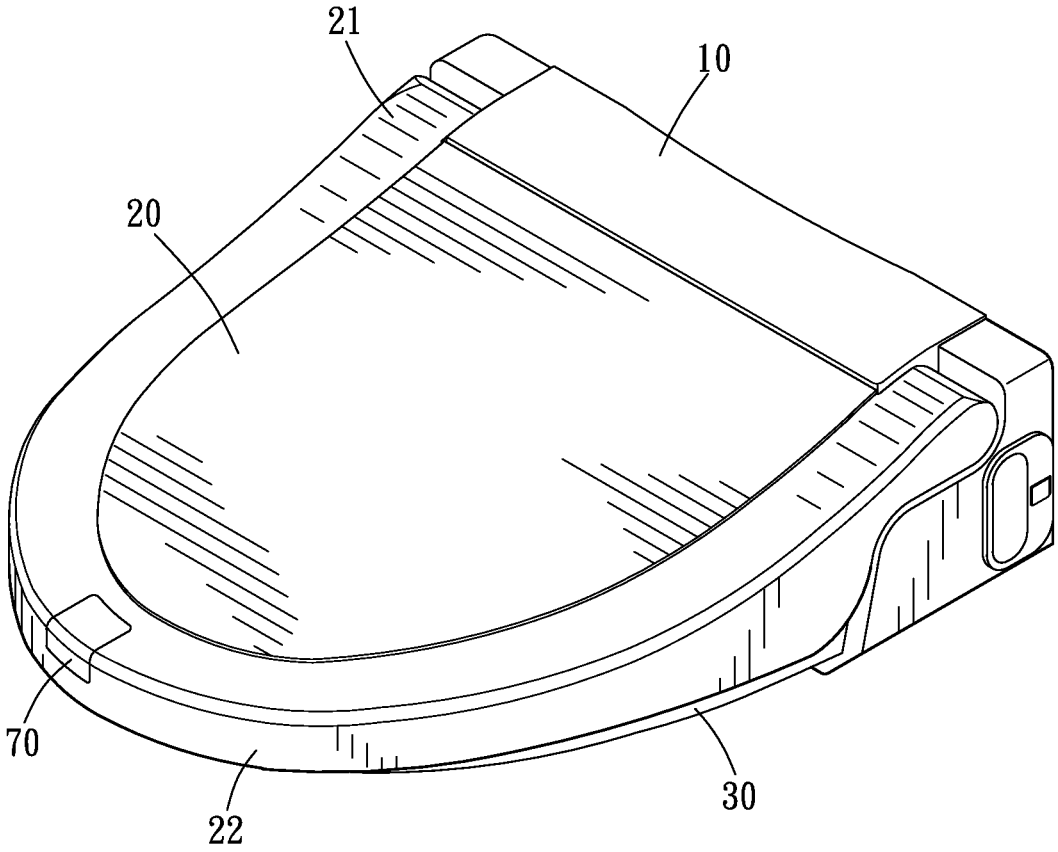
FIG. 3 is a stereogram of the present invention.

Please refer to FIG. 1, FIG. 3 and FIG. 7, the first sensor 70 is disposed on the second end 22 of the toilet lid and is connected to the micro processor 41 electrically. Also, direction of detection of the first sensor 70 is opposite to a direction from the second end 22 to the first end 21 of the toilet lid 2. As shown in FIG. 3, the first sensor is disposed on an edge of the second end of the toilet lid and extends to a top surface of the second end. In other possible embodiments, the first sensor can also be disposed on the edge of the second end of the toilet lid or the top surface of the second end directly.

Figure 4:
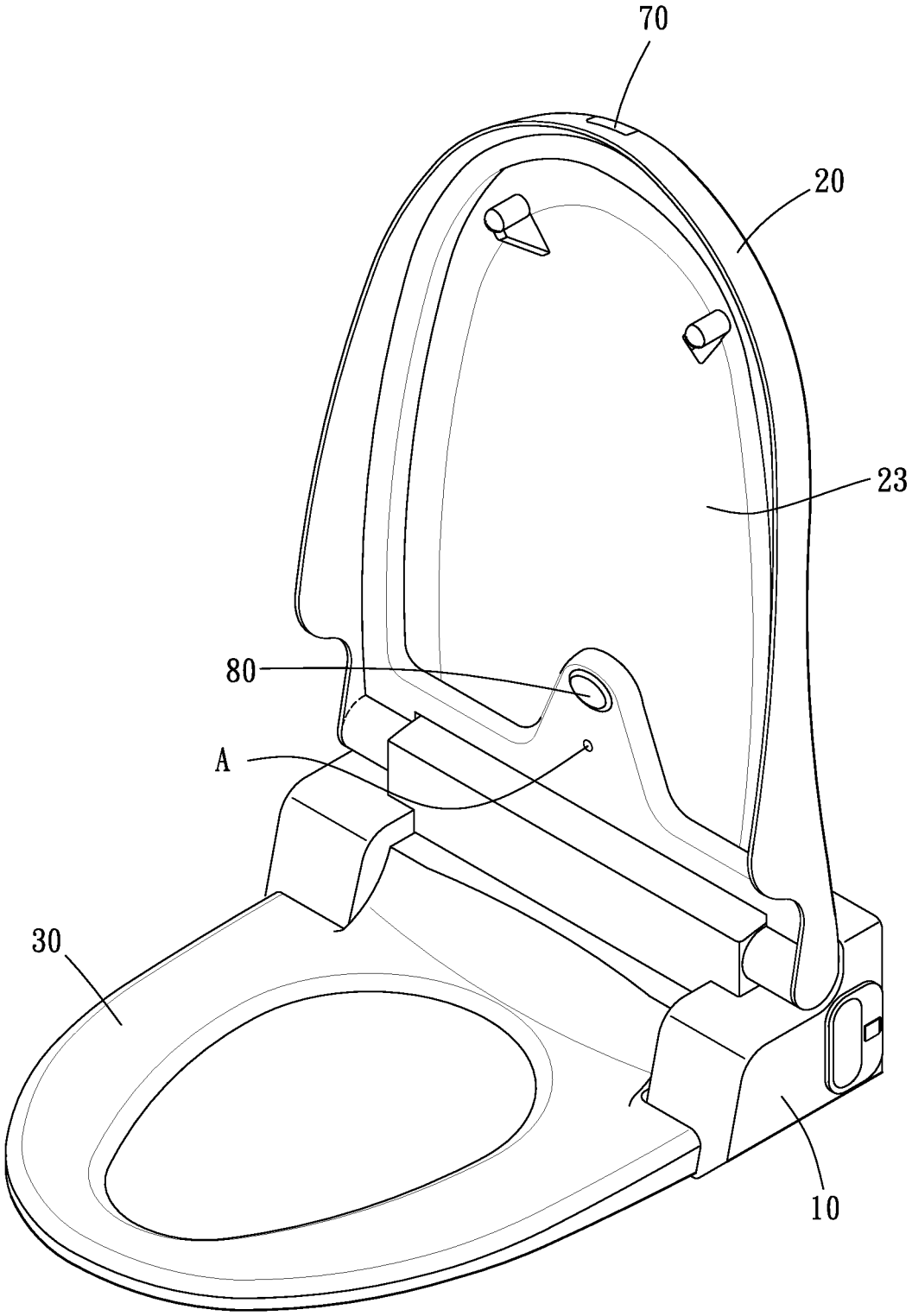
FIG. 4 is a schematic drawing showing the toilet lid lifted of the present invention.

FIG. 1, FIG. 4 and FIG. 7 show that the second sensor 80 is disposed on the closing face 23 of the toilet lid, and the second sensor 80 connects to the micro processor 41 electrically.

Please refer to FIG. 1 and FIG. 2, the power supply 90 is used for offering electricity to the controller 40, the first lid lifter 50, the second lid lifter 60, the first sensor 70, and the second sensor 80. The power supply 90 is disposed in the receiving room 111. In the preferred embodiment of the present invention, the power supply 90 includes a battery such as a rechargeable battery, a dry battery or a lithium battery, and the power supply can also be a plug.

The first adjusting unit is used for selecting one of the detecting ranges of the first sensor. The first adjusting unit includes an auto-switching member 423 disposed in the detecting module 42 and connecting to the first adjusting member 421 electrically. When the toilet lid 20 pivots to the lifting position or the closing position, the auto-switching member 423 triggers the first adjusting member 421 to switch among the detecting ranges. Preferably, the first adjusting member 421 defines a larger detecting range and a smaller detecting range. Therefore, when the toilet lid 20 pivots to the lifting position, the auto-switching member 423 triggers the first adjusting member 421 to switch to the larger detecting range. When the toilet lid 20 pivots to the closing position, the auto-switching member 423 triggers the first adjusting member 421 to switch to the smaller detecting range.

The second adjusting unit, including an adjusting button 113, is used for selecting one of the detecting ranges of the second sensor. The adjusting button 113 is disposed on the operation panel 112 and electrically connects to the second adjusting member 422. The adjusting button 113 is adapted for choosing a detecting range of the second sensor.

As shown in FIG. 3 and FIG. 4, when the toilet lid 20 and the seat 30 are located at the closing position and the first sensor detects movements of a human body, the micro processor 41 actiivates the second sensor 80 and the first lid lifter 50 to drive the toilet lid 20 to pivot to the lifting position. As such, a user can sit down on the seat to use the toilet.

As shown in FIG. 4, when a gentleman wants to urinate by standing and the toilet lid 20 has pivoted to the lifting position, the first sensor 70 faces upward so that the auto-switching member would switch the first adjusting member 421 from the larger detecting range to the smaller detecting range. Then, with waving hands above the first sensor 70, the micro processor 41 would trigger the second lid lifter 60 to drive the seat 30 to pivot to the lifting position. As such, by the present invention, the two-stage driving method of the seat and the toilet lid enables users to choose to sit down on the toilet or lift the seat according to their needs. No matter men or women, they do not have to lift the toilet lid by hands. Moreover, the two-stage design of auto-lifting method for the toilet lid can enhance men's willing to lift the seat and the toilet lid. As a result, the surface of the seat and the closing face of the toilet lid are prevented from being stained with urine or fecal matters.

When a user is absent from the detecting range of the second sensor 80, the micro processor 41 triggers the first lid lifter 50 and the second lid lifter 60 and deactivates the second sensor 80 so that the toilet lid 20 and the seat 30 would pivot to the closing position. At this moment, the auto-switching member 423 would switch the first adjusting member 421 from the smaller detecting range to the larger detecting range. Thus, the first sensor and the second sensor are back to an original state. And users do not have to close the seat or the toilet lid by hands after using, so the seat and the toilet lid would not be stained by the urine or fecal matters on hands. Furthermore, the micro processor would deactivate the second sensor for saving electricity as well.

By what is described above, when the toilet is positioned in a narrow lavatory, the second sensor would detect that other objects rather than human are located in the detecting range so that the toilet lid or the seat could not pivot to the closing position. However, a combination of the second adjusting member and the adjusting button allows users to adjust the detecting range of the second sensor according to the size of the lavatory.

Please refer to FIG. 1, FIG. 4, FIG. 6 and FIG. 7, the automatic toilet seat of the present invention further includes a third sensor A. The third sensor A, disposed on the closing face 23 of the toilet lid, electrically connects to the micro processor 41. The third sensor A is used for detecting movements of human. When the first sensor 70 detects movements of human, the micro processor 41 would start up the second sensor 80 and the third sensor A. When the second sensor 80 detects nothing in the detecting range and the third sensor detects human leaving, the micro processor would activate the first lid lifter 50 and the second lid lifter 60 and deactivate the second sensor and the third sensor. Thus, the toilet lid 20 and the seat 30 would pivot to the closing position. As such, if the second sensor is equipped with infrared rays device which have angle limitations on detecting, some tall men may not be detected in the detecting range. Thus, the third sensor can be used as an enhancing mechanism.

What is claimed is:

1. An automatic toilet seat, comprising:

a base body, the base body being adapted for being disposed on a toilet;

a toilet lid, comprising a first end and a second end, the first end being pivotally disposed with the base body;

a seat, the seat being pivotally disposed on the base body, the seat is located between the toilet and the toilet lid;

a controller, comprising a micro processor;

a first lid lifter, the first lid lifter connecting to the micro processor electrically, the first lid lifter being used for enabling the toilet lid to pivot between a lifting position and a closing position;

wherein when the toilet lid is located at the closing position, a face of the toilet lid facing the toilet is defined as a closing face;

a second lid lifter, the second lid lifter connecting to the micro processor electrically, the second lid lifter being used for enabling the seat to pivot between a lifting position and a closing position;

a first sensor, the first sensor being disposed on the second end of the toilet lid, the first sensor connecting to the micro processor electrically, direction of detection of the first sensor being opposite to a direction defined from the second end to the first end of the toilet lid;

a second sensor, the second sensor being disposed on the closing face of the toilet lid, the second sensor connecting to the micro processor electrically; and a power supply, the power supply for offering electricity to the controller, the first lid lifter, the second lid lifter, the first sensor, and the second sensor; wherein when toilet lid and the seat are located at the closing position and the first sensor detects an object approaching, the micro processor activates the second sensor and the first lid lifter for driving the toilet lid to pivot to the lifting position; wherein when the toilet lid is located at the lifting position and the first sensor detects an object, the micro processor activates the second lid lifter for driving the seat to pivot to the lifting position; wherein when the object is absent from a detecting range of the second sensor, the micro processor activates the first lid lifter and the second lid lifter and deactivates the second sensor to make the toilet lid and the seat pivot to the closing position;

wherein the controller comprises a detecting module connecting to the micro processor electrically, the detecting module comprises a first adjusting member defining plural detecting ranges of the first sensor, the controller further comprises a first adjusting unit used for selecting one of the detecting ranges of the first sensor, the controller comprises a detecting module connecting to the micro processor electrically, the detecting module comprises a first adjusting member defining plural detecting ranges of the first sensor, the controller further comprises a first adjusting unit used for selecting one of the detecting ranges of the first sensor.

2. The automatic toilet seat of claim 1, wherein the detecting module comprises a second adjusting member defining plural detecting ranges of the second sensor, the base body further comprises a second adjusting unit used for selecting one of the detecting ranges of the second sensor.

3. The automatic toilet seat of claim 2, wherein the second adjusting unit comprises an adjusting button electrically connecting to the second adjusting member, the adjusting button is used for being pressed to select one of the detecting ranges of the second sensor.

4. The automatic toilet seat of claim 1, wherein the first lid lifter is disposed in the base body, the first lid lifter comprises a first motor and a first rotator, the first motor connects to the micro processor electrically, the micro processor triggers the first motor to drive the first rotator to lift or close the toilet lid.

5. The automatic toilet seat of claim 2, wherein the first lid lifter is disposed in the base body, the first lid lifter comprises a first motor and a first rotator, the first motor connects to the micro processor electrically, the micro processor triggers the first motor to drive the first rotator to lift or close the toilet lid.

6. The automatic toilet seat of claim 4, wherein the second lid lifter is disposed in the base body, the second lid lifter comprises a second motor and a second rotator, the second motor connects to the micro processor electrically, the micro processor triggers the second motor to drive the second rotator to lift or close the seat.

7. The automatic toilet seat of claim 5, wherein the second lid lifter is disposed in the base body, the second lid lifter comprises a second motor and a second rotator, the second motor connects to the micro processor electrically, the micro processor triggers the second motor to drive the second rotator to lift or close the seat.

8. The automatic toilet seat of claim 1, wherein the toilet seat sensor further comprises a third sensor, the third sensor is disposed on the closing face of the toilet lid, the third sensor connects to the micro processor electrically, the third sensor is used for detecting movements of a human body.

9. The automatic toilet seat of claim 2, wherein the toilet seat sensor further comprises a third sensor, the third sensor is disposed on the closing face of the toilet lid, the third sensor connects to the micro processor electrically, the third sensor is used for detecting movements of a human body.

10. The automatic toilet seat of claim 3, wherein the toilet seat sensor further comprises a third sensor, the third sensor is disposed on the closing face of the toilet lid, the third sensor connects to the micro processor electrically, the third sensor is used for detecting movements of a human body.

11. The automatic toilet seat of claim 1, wherein the power supply comprises a rechargeable battery.

* * * * *